United States Patent [19]

Segersten

[11] 4,361,323

[45] Nov. 30, 1982

[54] PULLING APPARATUS WITH BUILT-IN WEIGHT MAGAZINE

[76] Inventor: Ragnar Segersten, Poppelgatan 28 A, Malmö, Sweden

[21] Appl. No.: 232,262

[22] PCT Filed: May 13, 1980

[86] PCT No.: PCT/SE80/00138

§ 371 Date: Jan. 13, 1981

§ 102(e) Date: Jan. 13, 1981

[87] PCT Pub. No.: WO80/02508

PCT Pub. Date: Nov. 27, 1980

[30] Foreign Application Priority Data

May 14, 1979 [SE] Sweden ..... 7904183

[51] Int. Cl.[3] ..... A63B 21/06

[52] U.S. Cl. ..... 272/118

[58] Field of Search ..... 272/118, 117, 93, 134, 272/DIG. 4

[56] References Cited

U.S. PATENT DOCUMENTS 848,272 3/1907 Thornley ..... 272/118

FOREIGN PATENT DOCUMENTS 11226 11/1909 France ..... 272/118

389026 12/1974 Sweden .

*Primary Examiner*—Richard C. Pinkham

*Assistant Examiner*—William R. Browne

*Attorney, Agent, or Firm*—Laurence R. Brown

[57] ABSTRACT

A pulling apparatus has a stand (1) with vertical legs (2) which guide a weight magazine (7) for vertical movement. The magazine, which is a bottomless basket with a row of holes (12) in the side surfaces, is intended for weights (14) in a stack. These weights are provided with yoke-shaped components (15) which serve on the one hand as guides between the weights, and on the other hand as spacers. The distance between the magazine holes corresponds to the spacing between the respective weights so that a lifting plate (13) can be introduced into the hole between the weights.

3 Claims, 2 Drawing Figures

PULLING APPARATUS WITH BUILT-IN WEIGHT MAGAZINE

TECHNICAL FIELD

The present invention relates to a pulling apparatus, intended for muscle training and comprising a substantially vertical stand, a stack of weights, a magazine for the weights, a rope, fixed to the magazine and laid over a suitable pulley or the like, and members for coupling the magazine to the desired number of weights.

Prior Art

Various types of such pulling apparatuses, which can be used for training a number of muscles in the body, are known. Since the weights are collected in some magazine-like device, the number of weights and thus the magnitude of the load can be altered as necessary.

In a previously known pulling apparatus, which can be regarded as the prior art, vertical plate guides or tunnels with longitudinal epoxy rails, against which the weights in the stack are intended to slide, are disposed in the vertical stand. In this case, the magazine is formed in principle of side plates, guided by the plate guides. In order to make it possible to introduce coupling members between the weights to bring up the required number, rubber plates are provided as spacing members. Experience has shown that these plates settled, and so the division between the weights altered with consequent problems.

The construction is thus comparatively complicated and therefore expensive and does not have a very satisfactory operation because of guiding and sliding problems.

The invention

These disadvantages are overcome in a pulling apparatus according to the invention, which is characterized in that the magazine has the form of a bottomless basket, in the side surfaces provided with holes disposed one above the other with a division corresponding to the spacing between the weights in the stack, and that the weights are provided with yoke-spaced components which on the one hand serve as guides between the weights and on the other hand form spacers between them.

Since the magazine is here closed even at the short sides, it can be controlled directly by the vertical legs of the stand, simply and with little friction.

A lifting plate, which serves as a coupling member and storage plate for the weights above it, which are to be lifted by means of the rope, can be pushed through the holes in the magazine, which are oblong, and between adjacent weights in the stack.

The pulling apparatus according to the invention is characterized primarily by three features: robust construction, low friction in the gudies of the magazine and simple design.

THE DRAWINGS

The invention will be described in more detail below with reference to the accompanying drawings, in which FIG. 1 is a perspective view of a pulling apparatus according to the invention and FIG. 2 shows a weight magazine and a stack of weights for this pulling apparatus.

DESCRIPTION OF A PREFERRED EMBODIMENT

Figure 1:
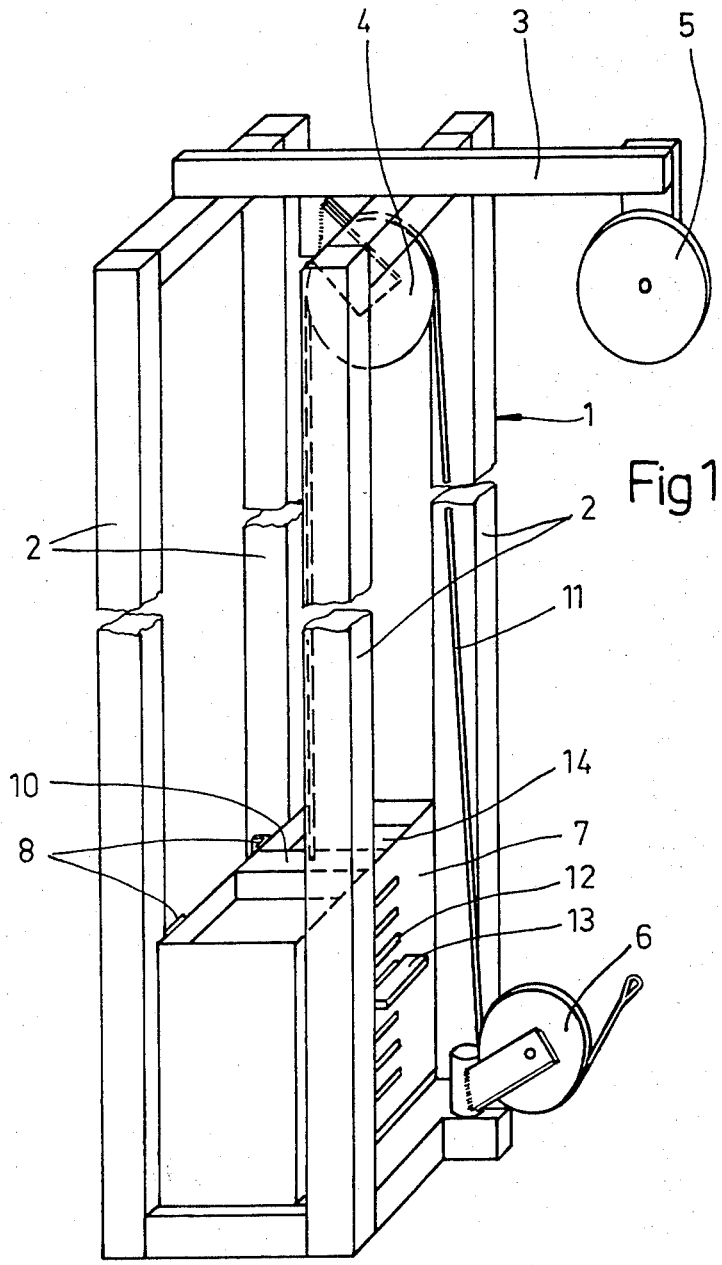

As shown in FIG. 1 a simple stand 1, which is preferably welded together, comprises four vertical legs 2 and a crossbar 3 which, in the case shown, is provided with two rotatable pulleys 4 and 5, while a further pulley 6 is disposed in the lower portion of the stand.

Figure 2:
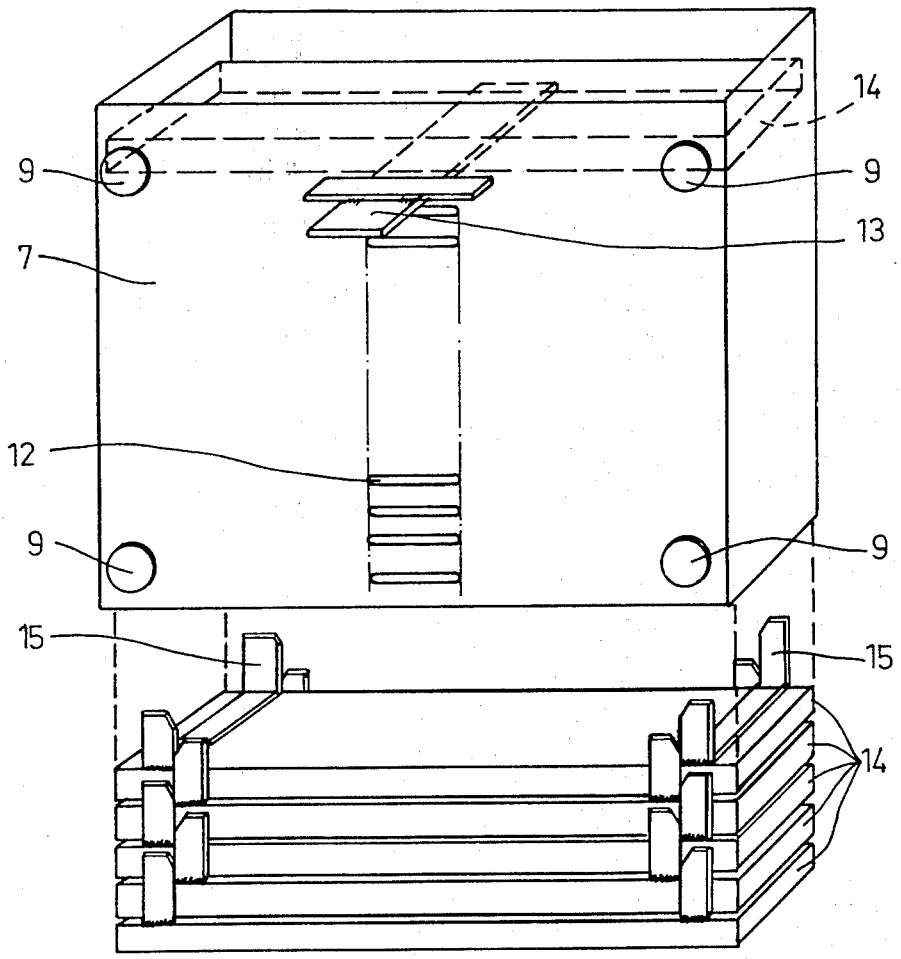

A weight magazine 7 is guided by the legs 2 of the stand for vertical movement, at the back by means of lateral guides 8 and at the front by means of sliding studs 9 (FIG. 2). At its upper portion, the magazine is provided with a cross-piece 10 (omitted in FIG. 2) to which a rope 11 is fixed. This rope can run over the pulleys 4 and 6, as shown in FIG. 1, so that a vertically upwardly directed or more or less horizontal pull in the rope lifts the magazine 7. Alternatively, the rope can run over the two upper pulleys 4 and 5 so that a downward force in the rope causes the lifting of the magazine 7.

The magazine 7, which consists of two side walls and two short sides but does not have any bottom, is equipped in its side walls with a number of horizontal slots 12, disposed one above the other. A lifting plate 13, the length of which exceeds the width of the magazine, can be pushed into a pair of slots, which can be freely selected.

The magazine 7 is adapted to entrain one or more weights 14, disposed in a stack in the stand, by means of the lifting plate 13. Each weight 14 is provided at each end with a yoke-shaped component 15—displaced alternately on every other weight, as seen from FIG. 2. The purpose of these components 15 is to serve on the one hand as guides (with their vertical parts), and on the other hand as spacing members between the weights 14. The division between the weights 14 corresponds to the division between the holes 12, so that when the lifting plate 13 is pushed into these holes, it can fit between two weights in the stack.

When the magazine 7 is lifted by means of the rope 11, the weights 14 over the lifting plate 13 are entrained, while the weights below it remain locked to one another by means of the components 15. When the magazine is lowered again, the weights therein are caught by the guide components 15 which have a shape permitting certain displacements both forwards and backwards and sideways.

Modifications are possible within the scope of the following claims.

I claim:

1. A pulling apparatus, intended for muscle training and comprising a substantially vertical stand (1), a stack of weights (14), a weight lifting magazine (7) the weights, a magazine lifting which receives rope (11) fixed to the magazine and laid over suitable pulleys (4-6), and lifting plate members (13) for coupling the magazine to the required number of weights, said weight lifting magazine (7) has the form of a bottomless basket, said magazine having a side surface provided with holes (12) for receiving the lifting plate members, said lifting plate members disposed one above the other with a division corresponding to the spacing between the weights (14) in the stack, the weights are provided with yoke-shaped components (15), which serve on the one hand as guides for the weights and on the other hand form spacers between the weights.

2. An apparatus as claimed in claim 1, wherein the magazine (7) is guided by the vertical legs (2) of the stand.

3. An apparatus as claimed in claim 1 or 2, wherein a lifting plate (13), which serves as a coupling member and storage plate for the weights above it which are to be lifted by means of the rope (11), can be pushed through the holes (12) in the magazine, which are oblong, and between adjacent weights (14) in the stack.

* * * * *